US005824944A

United States Patent [19]

Dippold et al.

[11] Patent Number: 5,824,944

[45] Date of Patent: Oct. 20, 1998

[54] METALLIC SLUG FOR INDUSTRIAL BALLISTIC TOOL

[75] Inventors: Jack D. Dippold, Edwardsville; Melvin W. Harris, Warden, both of Ill.; Mark R. Miller, Rapid City, S. Dak.

[73] Assignee: Olin Corporation, East Alton, Ill.

[21] Appl. No.: 862,048

[22] Filed: May 22, 1997

[51] Int. Cl.[6] ..... F42B 5/02

[52] U.S. Cl. ..... 102/439; 102/448; 102/501; 42/78

[58] Field of Search ..... 102/430, 439, 102/448, 449, 501, 514–517, 519, 524, 526, 532; 42/78; 227/9, 10

[56] References Cited

U.S. PATENT DOCUMENTS

| | | | |
|---|---|---|---|
| 37,193 | 12/1862 | Alsop . | |
| 2,700,839 | 2/1955 | Finlay et al. | 42/79 |
| 3,232,233 | 2/1966 | Singleton | 102/501 |
| 3,367,055 | 2/1968 | Powell | 42/79 |
| 3,496,667 | 2/1970 | Lowry | 42/78 |
| 3,802,108 | 4/1974 | Mainhardt et al. | 42/76 |
| 4,071,971 | 2/1978 | Tornas | 42/79 |
| 4,413,564 | 11/1983 | Brown | 102/501 |
| 4,546,564 | 10/1985 | A'Costa | 42/76 |
| 4,660,312 | 4/1987 | A'Costa | 42/76.01 |
| 4,805,536 | 2/1989 | Kosteck | 102/514 |
| 4,841,657 | 6/1989 | Mossberg | 42/76.01 |
| 4,864,934 | 9/1989 | Theising | 102/430 |
| 5,038,507 | 8/1991 | Dennis, Jr. | 42/70.06 |
| 5,249,385 | 10/1993 | Vang et al. | 42/79 |
| 5,272,827 | 12/1993 | Vang et al. | 42/79 |
| 5,394,634 | 3/1995 | Vang et al. | 42/79 |
| 5,408,931 | 4/1995 | Tallman | 102/439 |
| 5,452,535 | 9/1995 | See et al. | 42/79 |
| 5,535,495 | 7/1996 | Gutowski | 29/1.22 |

FOREIGN PATENT DOCUMENTS

| | | | |
|---|---|---|---|
| 2609540 | 7/1988 | France | 102/501 |
| 4227068 | 2/1994 | Germany | 102/514 |

OTHER PUBLICATIONS

Shooting Zinc by Karl Bosselmann, Handloader's Digest 12th Ed. 1990 pp. 128–132.

Kenneth S. Hulme: "Basics of Twist" appearing in *Handloader 120,* Mar.–Apr. 1986 at pp. 36–37 and 55–56.

C.E. Harris: "The Importance of Twist Rate" appearing in *Rifle,* May–Jun. 1986 at pp. 32–35 and 48–50.

Winchester Ammunition, *Winchester Industrial Guns and Ammunition,* Jul. 1996.

*Primary Examiner*—Harold J. Tudor

*Attorney, Agent, or Firm*—Gregory S. Rosenblatt; Wiggin & Dana

[57] ABSTRACT

A projectile for an industrial ballistic tool is formed from zinc or a zinc based alloy. The projectile has symmetry about a longitudinal axis and a rear portion of the projectile engages rifling, either within the barrel of the industrial ballistic tool or in a rifled extension, imparting ballistic stability. The projectile is particularly suited for high temperature industrial applications, such as removal of "clinkers" from cement kilns or lime kilns or removal of a plug when tapping an electric arc furnace, as used in the manufacture of metallic alloys such as ferrosilicon. The vaporization temperature of the projectile is sufficiently low that after effecting removal of the clinker or plug, the projectile vaporizes and does not contaminate the kiln, furnace or end product such as lime, cement or metallic alloy.

6 Claims, 8 Drawing Sheets

METALLIC SLUG FOR INDUSTRIAL BALLISTIC TOOL

BACKGROUND OF THE INVENTION

1. Field of the Invention

This invention relates to a metallic slug for expulsion from an industrial ballistic tool. More particularly, improved accuracy is achieved by forming a rearward portion of the metallic slug with a diameter effective to engage a rifled extension to the tool barrel.

2. Background of the Invention

Rotary kilns, which are used to calcine cement and lime, are typically 3 to 7 meters in diameter and 30 to 150 meters long. Calcining takes place at elevated temperatures, typically in the range of 1100° C. to 1500° C. During the calcining process, because of many processing variables, the product may adhere to the sidewalls of the kiln forming a clinker, ring or dam. If this adherent obstruction is not removed, additional product will accumulate, reducing or stopping product throughput. Removal of the obstruction is necessary.

It is not economically feasible to stop the kiln to remove the obstruction. Also, considering that the ring may form 5 to 10 meters from the end of the kiln, it is not safe for an operator to manually remove the obstruction with long poles or other methods. Some users of rotary kilns utilize industrial ballistic tools. A tool operator will position the tool in a port door and then fire metallic projectiles at the obstruction, thereby removing the obstruction from the sidewalls of the kiln.

Industrial ballistic tools are also utilized by manufacturers of steel and ferrosilicon. Prior to casting these metals, molten metal is contained within an electric furnace sealed by a carbon (or clay) base plug. Since the molten metal is at a temperature in excess of 2500° C., manual removal of the plug is not feasible. One way that the plugs are removed is with an industrial ballistic tool. A metallic projectile is fired from the industrial ballistic tool to break open the plug, starting the flow of molten metal. To prevent contamination of the metal, the projectile should vaporize on contact with the molten metal.

The metallic projectiles are usually formed from lead, a dense material with a relatively low vaporization (boiling) temperature of 1750° C. The lead projectiles knock clinkers from the kiln walls and then fall into the kiln and are vaporized.

Due to environmental concerns, lead is being phased out as a projectile for industrial ballistic tools. Several substitutes have, to date, proven unsatisfactory. Steel projectiles are effective for removing clinkers, but due to the high vaporization temperature of iron, in excess of 2500° C., the steel does not vaporize and may contaminate the kiln. Steel is also much harder than lead causing the steel based projectiles to be prone to ricochet, potentially damaging the kiln.

Zinc and zinc alloys have also been utilized as lead substitutes. Zinc has a vaporization temperature of 906° C., and vaporizes in the kiln. However, the density of zinc is 7.1 $gm/cm^3$, only about 60% that of lead (11.2 $gm/cm^3$). The effectiveness of a projectile in removing a clinker is dependent on the momentum (mass×velocity) of the projectile. The velocity is limited by the ballistic powder charge safely contained within the industrial ballistic tool. Therefore, to match the momentum of a lead projectile, a larger mass of zinc is required.

The diameter of a projectile is limited by the ballistic tool gauge, typically 8 gauge, although larger gauges are sometimes used. The only way to increase the mass of a zinc based projectile is to extend the length. Longer length zinc based projectiles have proven unsatisfactory. While a lead based projectile has a length substantially equal to its radial cross-sectional area and mimics a sphere having a ballistically stable flight, even if end over end rotation commences, extended length zinc projectiles do not mimic a sphere and in end over end rotation, lose both ballistic stability and accuracy. If the side of a zinc based projectile strikes a clinker or ring, the projectile is prone to ricochet, placing the tool operator at risk.

Due to the phasing out of lead based projectiles, there remains a need for a non-lead based metallic projectile for use with industrial ballistic tools that does not suffer from the above stated disadvantages.

SUMMARY OF THE INVENTION

Accordingly, it is an object of the invention to provide a metallic projectile for expulsion from an industrial ballistic tool effective to remove clinkers from kilns and carbon or clay plugs from electric furnaces. It is a feature of the invention that the metallic projectile is formed from zinc or a zinc based alloy. It is another feature of the invention that the projectile vaporizes at a temperature below 1500° C. Yet another feature of the invention is that the projectile has a rear portion with a generally circular radial cross-section, of substantially constant cross-sectional area that engages a rifled extension of the industrial ballistic tool to improve ballistic stability and accuracy.

Among the advantages of the metallic projectiles of the invention are that they vaporize at a temperature below 1500° C. and, while essentially lead-free, have a momentum substantially equivalent to that of a lead-based projectile. The metallic projectile is, further, relatively soft and suitable for engaging the rifling of a ballistic tool barrel extension.

In accordance with the invention, there is provided a projectile for expulsion from an industrial ballistic tool. The projectile, a metallic slug formed from a metal or metal alloy having a vaporization temperature of less than 1500° C., has symmetry about a longitudinal axis and a radial circular cross-sectional area about that longitudinal axis. The metallic slug has a center of gravity disposed along the longitudinal axis. The radial circular cross-sectional area is greatest, and substantially constant, from a rear end of the metallic slug to a point forward of the center of gravity. The cross-sectional area of the metallic slug decreases forward of this point.

The above stated objects, features and advantages will become more apparent from the specification and drawings that follow.

DETAILED DESCRIPTION

Figure 1:
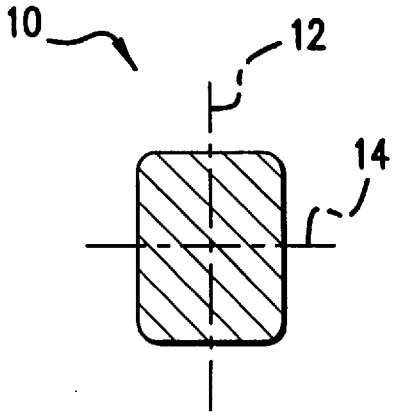
FIG. 1 PRIOR ART
FIG. 1 shows in cross-sectional area a lead based projectile in accordance with the prior art.

FIG. 1 shows in cross-sectional representation a lead based projectile 10, as known from the prior art. The projectile 10 typically has a weight of about 3 ounces. The projectile 10 has symmetry about a longitudinal axis 12 and a generally circular cross-sectional area when viewed along a radial axis 14 that intersects the longitudinal axis 12.

The length of the projectile 10, measured along the longitudinal axis, is only slightly more than the diameter measured along the radial axis 14. The projectile 10 is a right cylinder that approximates a sphere. In flight rotation of the projectile 10 does not significantly degenerate ballistic stability or effectiveness for clinker removal.

The lead based projectile 10 has a diameter suitable for an industrial ballistic tool, typically 8 gauge or larger. For an 8 gauge industrial ballistic tool, the projectile diameter is on the order of 0.825 inch.

Figure 2:
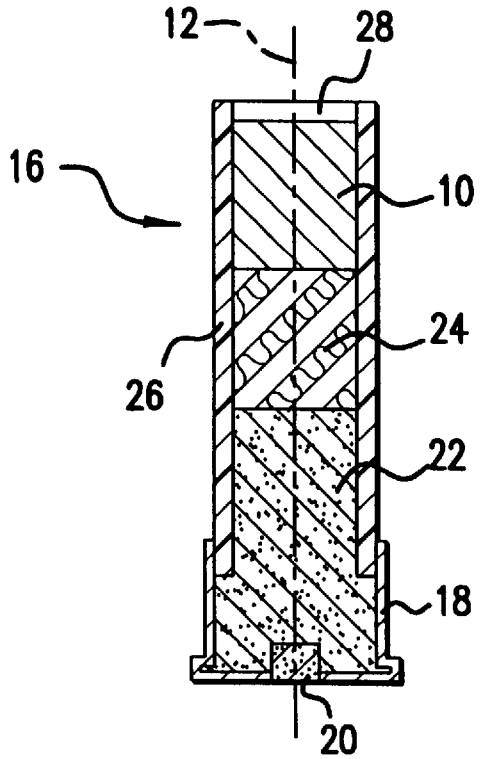
FIG. 2 PRIOR ART
FIG. 2 shows in cross-sectional area the lead based projectile of FIG. 1 encased in a shotgun shell.

FIG. 2 shows in cross-sectional representation a shotshell 16 encasing the lead based projectile 10. The shotshell 16 includes a metallic base cap 18 with a centrally disposed impact sensitive primer 20 in communication with a ballistic charge 22. Other types of primers, such as electrically activated, may readily be used. The ballistic charge 22 is typically a volume of gun powder rated as safe for a given shotshell. For a typical 8 gauge industrial ballistic tool, a 96 grain gun powder charge is typical. Disposed between the ballistic charge 22 and the projectile 10 is cushioning 24. The cushioning 24 is typically a wad of paper or plastic that absorbs a portion of the recoil generated upon ignition of the ballistic charge. A hollow cylindrical plastic or paper tube 26 aligns the shotshell components along longitudinal axis 12. A crimp 28 seals the assembly. The crimp 28 may be a portion of the plastic tube 26 or a separate component.

Lead based projectiles are being phased out for environmental reasons. A suitable replacement for lead should have a density close to that of lead, preferably in excess of 5 g/cm$^3$, and a vaporization temperature sufficiently low that the projectile will vaporize in a cement kiln, lime kiln or electric furnace.

As illustrated in Table 1, zinc and zinc alloys are preferred materials.

TABLE 1

| METAL | DENSITY (gm/cm$^3$) | VAPORIZATION TEMPERATURE (°C.) |
|---|---|---|
| LEAD | 11.2 | 1750 |
| ALUMINUM | 2.7 | 2494 |
| COPPER | 8.9 | 2595 |
| IRON | 7.9 | 2870 |
| TUNGSTEN | 19.3 | 5700 |
| ZINC | 7.1 | 906 |

Figure 3:
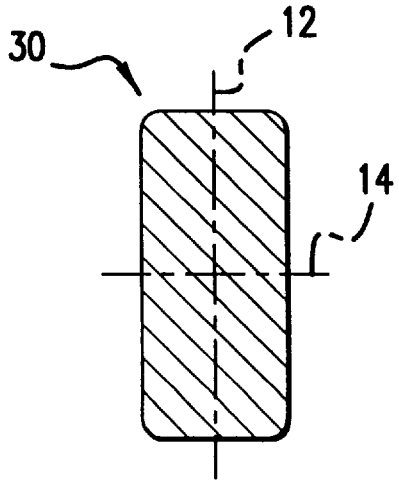
FIG. 3 PRIOR ART
FIG. 3 shows in cross-sectional area a zinc based projectile as known from the prior art.

Die cast zinc based alloys, such as a zinc alloy containing small additions of magnesium and aluminum, have been previously formed into projectiles for industrial ballistic tools. These projectiles 30, illustrated in cross-sectional representation in FIG. 3, are symmetric about a longitudinal axis 12 and have a generally circular cross-sectional area about the radial axis 14. Since zinc has a density of only about 60% that of lead and the diameter is fixed for a given gauge, the length is increased by a commensurate amount. The length of the prior art zinc base projectile 30, as measured along longitudinal axis 12 is about 67% longer than a lead-based projectile. As a result, the zinc based projectile 30 is a right cylinder that does not simulate a sphere. End over end rotation in flight causes decreased ballistic stability and accuracy.

Figure 4:
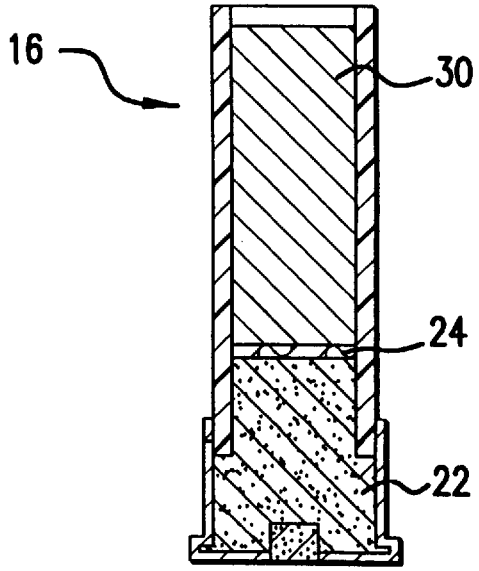
FIG. 4 PRIOR ART
FIG. 4 shows in cross-sectional representation the zinc based projectile of FIG. 3 encased in the shotgun shell.

A further problem with the zinc based projectile 30 is illustrated in FIG. 4. The dimensions of the shotshell 16 are the same as those employed with lead-based projectiles to avoid re-tooling of the ballistic tool. The volume of ballistic charge 22 is also retained to maximize projectile velocity. To provide space in the shotshell to accommodate the longer zinc-based projectile, the thickness of the cushioning 24 is reduced. This creates a serious ballistic problem. Lack of cushioning severely restricts the burn rate of the propellent in achieving the highest possible velocity and energy within maximum allowable pressure levels.

Figure 5A:
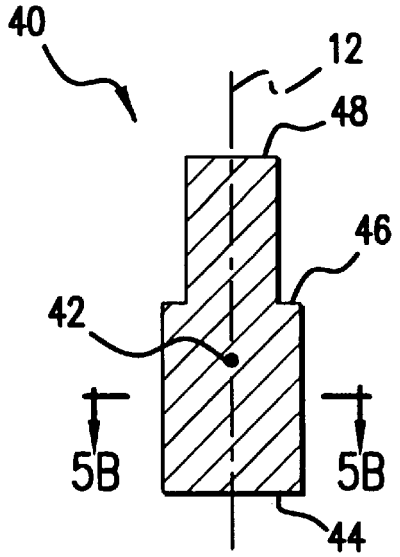
FIGS. 5A and 5B show in cross-sectional representation a first embodiment of the metallic slug of the invention.
Figure 5B:
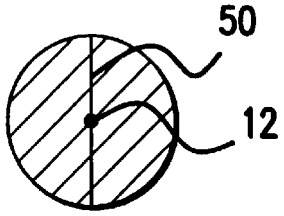

The above stated problems are solved with the zinc based projectile 40 of the invention illustrated in a first cross-sectional view in FIG. 5-A. The projectile 40, intended for expulsion from an industrial ballistic tool (not shown), is a metallic slug formed from a metal or metal alloy having a vaporization temperature of less than 1500° C. Preferably, the metallic slug is die cast from zinc or a zinc based alloy. One suitable zinc alloy is a zinc based alloy containing from about 4% to about 6%, by weight, of aluminum, either with or without an addition of magnesium. The balance of the alloy is substantially zinc.

The metallic slug has symmetry about a longitudinal axis 12 and, as best illustrated in FIG. 5-B, a radial circular cross-section of a desired diameter 50 about the longitudinal axis 12. Referring back to FIG. 5-A, the zinc based projectile 40 has a center of gravity 42 disposed along the longitudinal axis 12. The radial cross-sectional area of the zinc based projectile 40 is greatest from a rear end 44 of the zinc based projectile to a point 46 that is forward of the center of gravity 42. "Rear end" being defined as the portion of the projectile to last exit a tool barrel on firing. Forward of the point 46, the radial cross-section area decreases. Between the rear end 44 and the point 46, the radial cross-sectional area is substantially constant.

Since the mass of the projectile is concentrated rearward of the point 46, the center of gravity 42 is not centrally disposed along the longitudinal axis 12, rather located closer to the rear end 44 of the zinc based projectile than the front end 48 of the zinc based projectile. That makes zinc based projectiles particularly prone to end over front end rotation. To prevent end over end rotation, the diameter 50 (FIG. 5-B) of the constant radial cross-sectional area rear portion is sufficiently large to engage rifling of a ballistic tool barrel as described below. The rifling imparts spin about the longitudinal axis 12 to the projectile 40 imparting ballistic stability.

Figure 6:
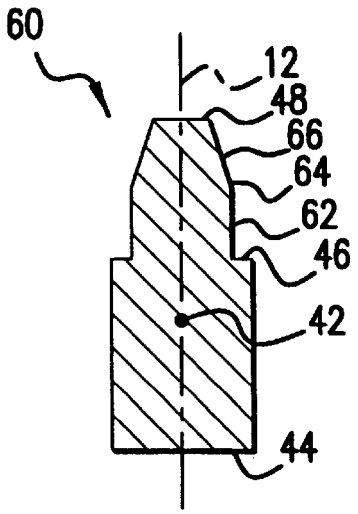
FIG. 6 shows in cross-sectional representation a second embodiment of the metallic slug of the invention.

The zinc based projectile 40 of FIG. 5-A is prone to ricochet. To reduce ricochet, a zinc based projectile 60, as illustrated in cross-sectional representation in FIG. 6, is preferred. The zinc based projectile 60 has symmetry about a longitudinal axis 12 and a center of gravity 42 rearward of the point 46. There is a discontinuity in the radial diameter at the point 46 such that the diameter decreases in step-like manner from a larger value in the rearward portion to a lower value in a mid-portion 62 with minimal to zero taper. The discontinuity is useful for aligning the zinc based projectile 60 in a shotshell.

A second point 64 separates the mid-portion 62 of substantially constant cross-sectional area, from a tapered front portion 66 that terminates at front end 48. The front end 48 has a radially circular cross-sectional configuration with a diameter that is from about 30% to about 50% of the diameter of the rear end 44. The small diameter front end 48 focuses the kinetic energy of the projectile to enhance clinker removal.

Figure 7:
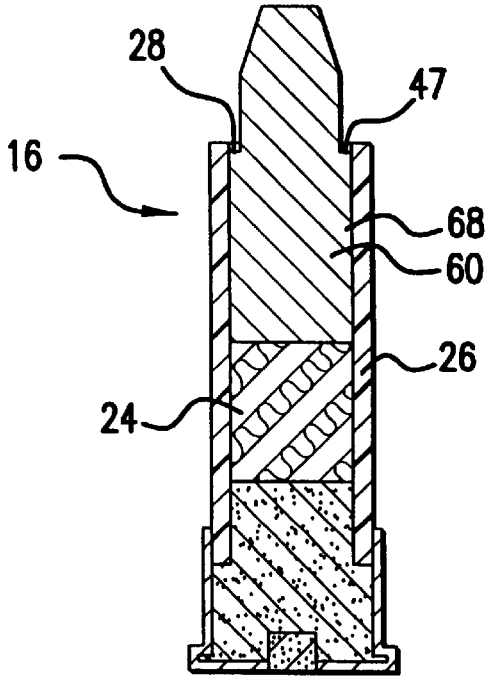
FIG. 7 shows in cross-sectional representation the projectile of FIG. 6 encased in a shotgun shell.

FIG. 7 shows a shotshell 16 encasing the projectile 60. The discontinuity 47 engages the crimp 28 extending from plastic, or paper, tube 26. Only the rear portion 68 of the projectile 60 is encased within the plastic, or paper, tube 26, allowing for a relatively large volume of cushioning 24, reducing recoil.

Figure 8:
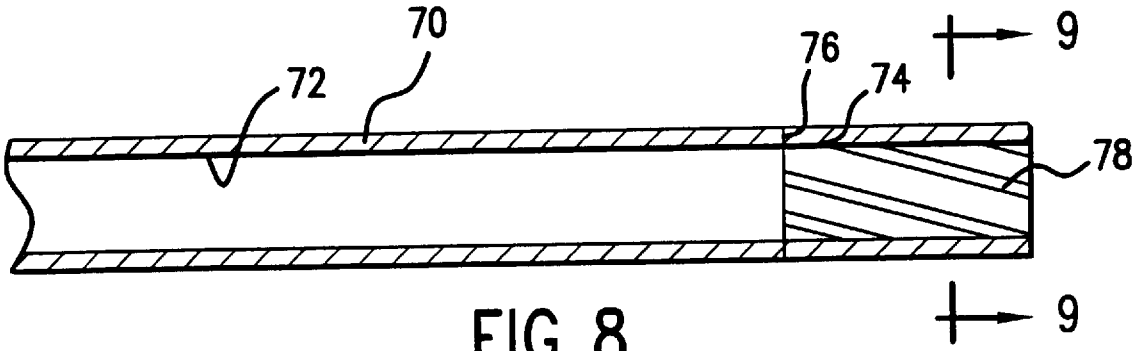
FIG. 8 shows in cross-sectional representation a rifled extension for use in combination with the metallic slugs of the invention.

As illustrated in FIG. 8, the barrel 70 of most industrial ballistic tools has a smooth bore, with an inner wall 72 free of rifling. In a different endeavor, smooth bore shotgun barrels are commonly used for hunting and sport shooting. Rifled shotgun barrels for these applications have been disclosed in U.S. Pat. No. 3,367,055 to Powell, as well as U.S. Pat. No. 4,660,312 to A'Costa, both of which are incorporated by reference in their entireties herein.

Typically, the barrel 70 of an industrial ballistic tool has a length of about 34 inches, slightly larger than a typical hunting or target (sport) shooting shotgun barrel length of between 26 inches and 34 inches. If the projectiles of the invention are fired from a smooth bore industrial ballistic tool, end to end rotation is likely.

Figure 9:
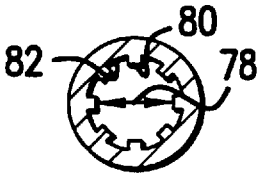
FIG. 9 shows another cross-sectional view of the rifled extension.

To improve ballistic stability, Applicants add a rifled extension 74 to the muzzle end 76 of the barrel 70. The rifled extension 74 has an inside diameter 78, as illustrated in FIG. 9. Measured from the peak of the rifling 80, the inside diameter of the rifled extension 74 is smaller than that of the rear portion of the zinc based projectile 60 that is illustrated in FIG. 6. The rear portion of the projectile 60 engages the rifling 80 of the rifled extension 74 with interference and is imparted with spin about the longitudinal axis of the projectile providing ballistic stability. The rifling 80 extends in helical fashion around the inner wall 82 of the rifled extension 74 completing one complete revolution about the inner wall over a distance of between 30 inches and 40 inches (referred to as a gain twist of between 30 and 40 inches). Since the rifled extension is typically much less than 30 inches long, more on the order of 7 to 10 inches long, the rifling typically does not complete one complete helical revolution about the rifled extension. Preferably, the gain twist is between 32 and 38. This gain twist is effective to impart the zinc based projectile with a spin rate of about 25,000 revolutions per minute about the longitudinal axis.

Figure 10:
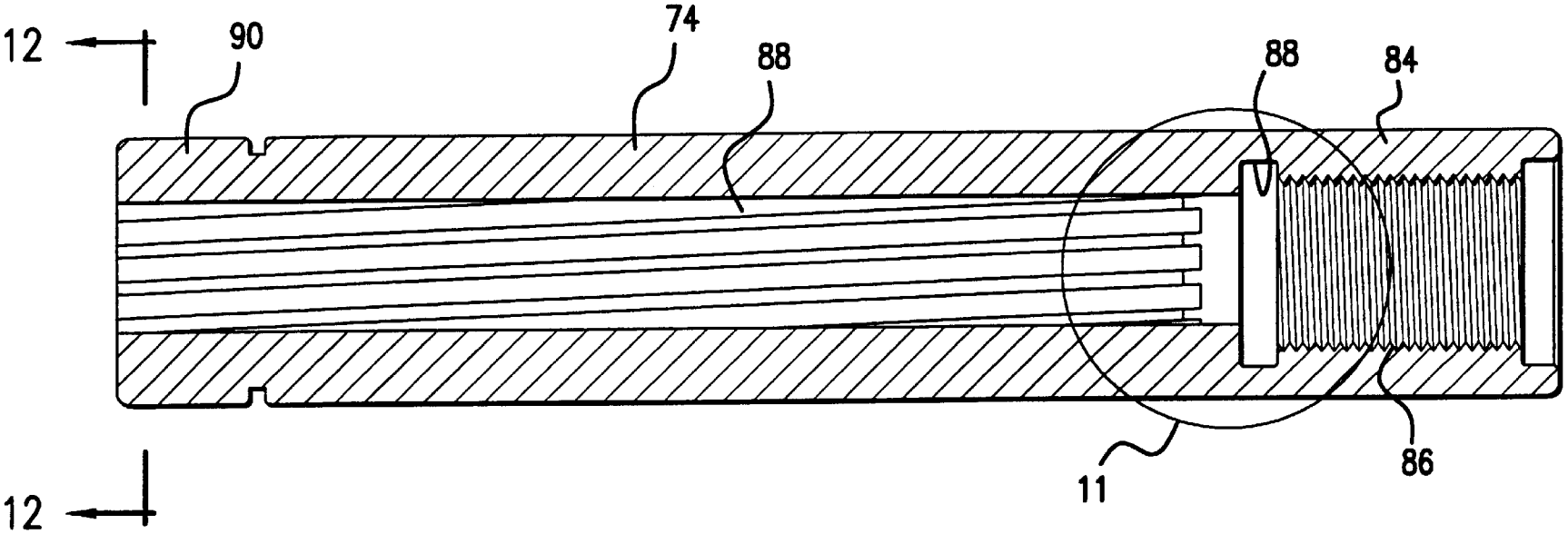
FIG. 10 shows in cross-sectional representation, a rifled extension for use with the projectile of the invention.
Figure 11:
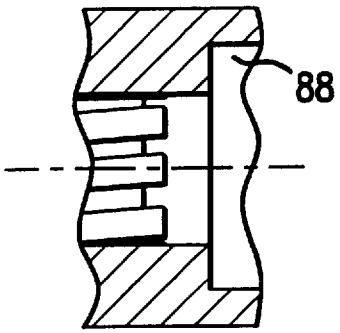

FIG. 10 illustrates the rifled extension 74 having a coupling portion 84 for engagement with the muzzle of an industrial ballistic tool. The coupling portion 84 has internal threads 86 that mate with threads (not shown) on the outside wall of the muzzle end of the ballistic tool barrel. The threaded coupling portion 84 terminates at a larger diameter transition portion 88, as best illustrated in FIG. 11, that momentarily slows down the projectile at the point of engagement with the rifling 80. This hesitation boosts the gas pressure trailing the projectile, burning the ballistic charge more completely, increasing projectile speed.

Figure 12:
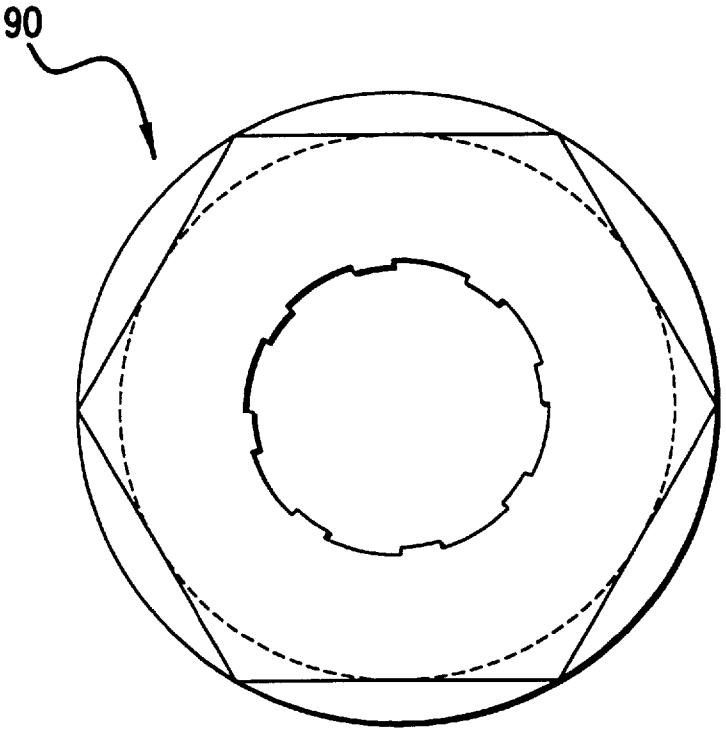
FIGS. 11 and 12 show in cross-sectional representation selected aspects of the rifled extension of FIG. 10.

Referring back to FIG. 10, the rifled extension 74 preferably has an open end 90 opposite the coupling portion 84. The open end 90 has, as illustrated in FIG. 12, a regular polyhedric shape, such as a hexagon or octagon, to facilitate engagement with a wrench or other tightening tool to improve coupling between the rifled extension and the muzzle of the industrial ballistic tool.

While the rifled extension has been described with rifling of a constant gain twist, it is within the scope of the invention to vary the gain twist within the rifled extension. Preferably, a higher gain twist is provided adjacent to the coupling portion and a lower gain twist at the open end. For example, the gain twist may be 40 inches at the coupling end and 32 inches at the open end. This decrease in gain twist causes a gradual increase in the rate of spin of the projectile and decreases the inertia resisting the initiation of spin, causing less wear on the rifling and longer life for the rifled extension.

The advantages of the invention will become more apparent from the examples that follow.

EXAMPLES

Figure 13:
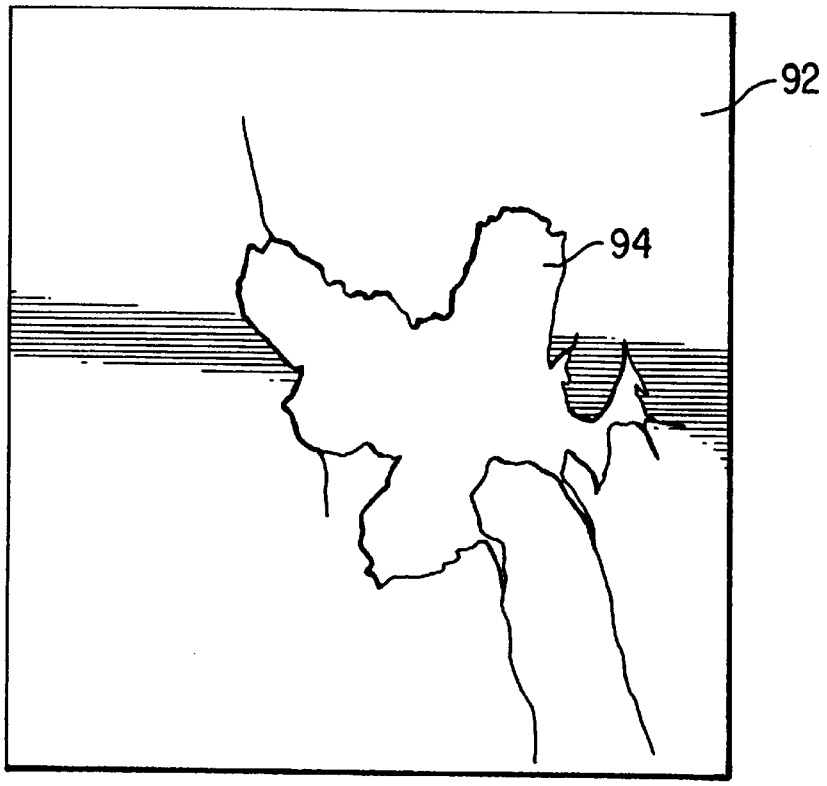
FIG. 13 shows an impact pattern at 25 feet achieved with the projectile of the invention without a rifled extension.

Zinc based projectiles having the shape illustrated in FIG. 6 were fired from a 8 gauge industrial ballistic tool at a paper target 92. As shown in FIG. 13, at a distance of 25 feet, the projectiles formed key-hole shaped openings 94 in the paper target 92 indicative of projectiles rotating end over end.

Figure 14:
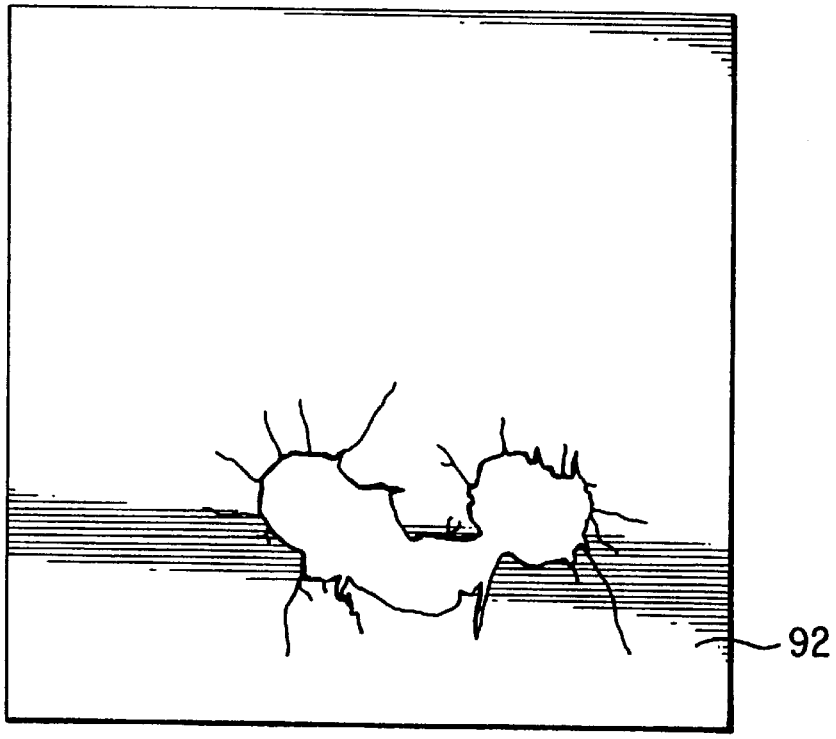
FIG. 14 shows an impact pattern at 25 feet achieved by the projectile of the invention with a rifled extension.

A rifled extension having a seven inch rifled portion with a 32 inch gain twist, manufactured by H-S Precision, Inc. of Rapid City, S.D., was then attached to the muzzle of the industrial ballistic tool. Zinc based projectiles of the type illustrated in FIG. 6 were fired at paper target 25 at a distance of 25 feet forming the hole pattern shown in FIG. 14. The hole pattern of FIG. 14 is indicative of projectiles entering the target with ballistic stability.

Figure 15:
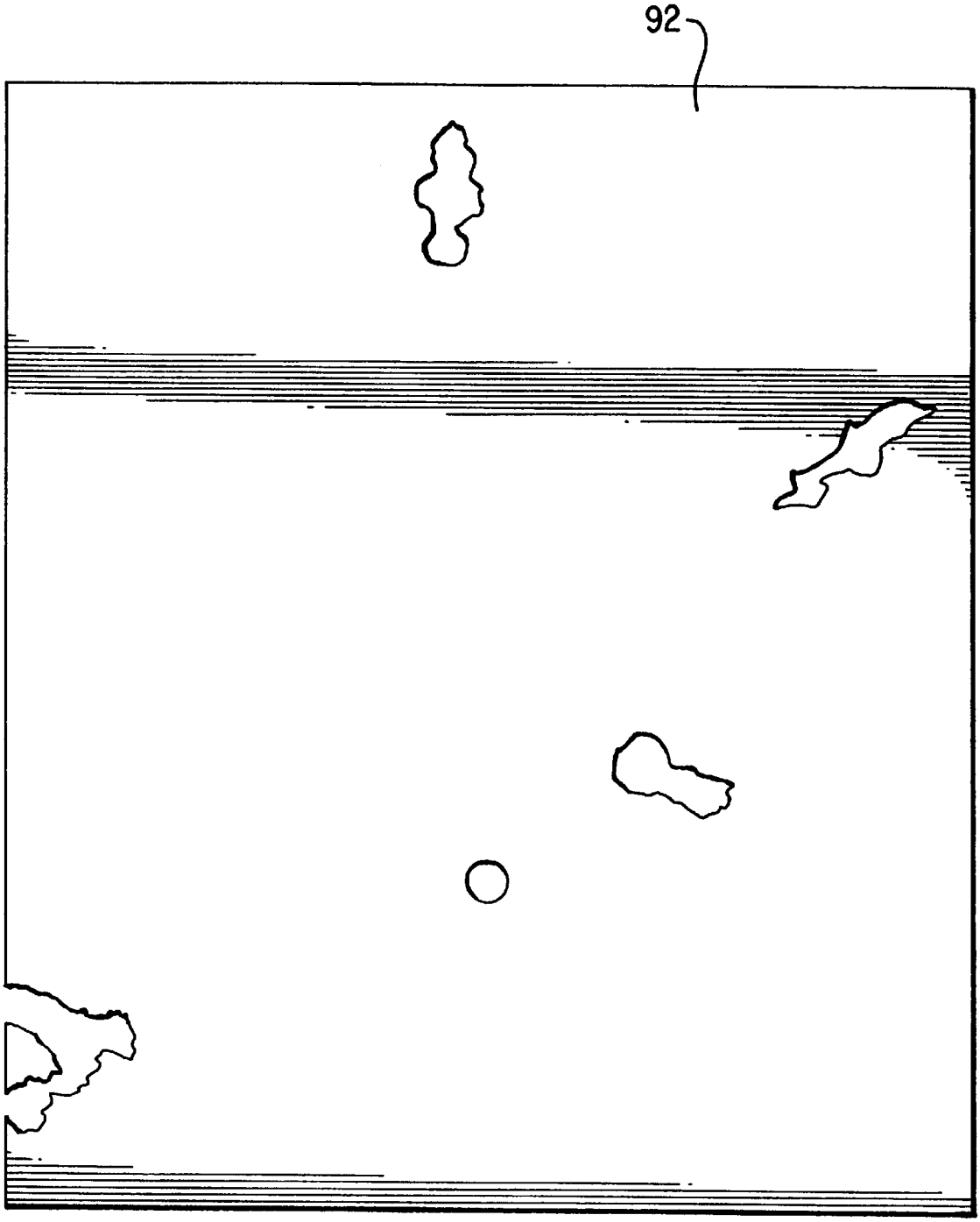
FIG. 15 shows an impact pattern of the projectile of the invention at 60 feet without a rifled extension.

FIG. 15 shows that at 60 feet, key-holing and excessive dispersion was a problem when the zinc based projectiles of the type illustrated in FIG. 6 were fired from a smooth bore industrial ballistic tool at paper target 92.

Figure 16:
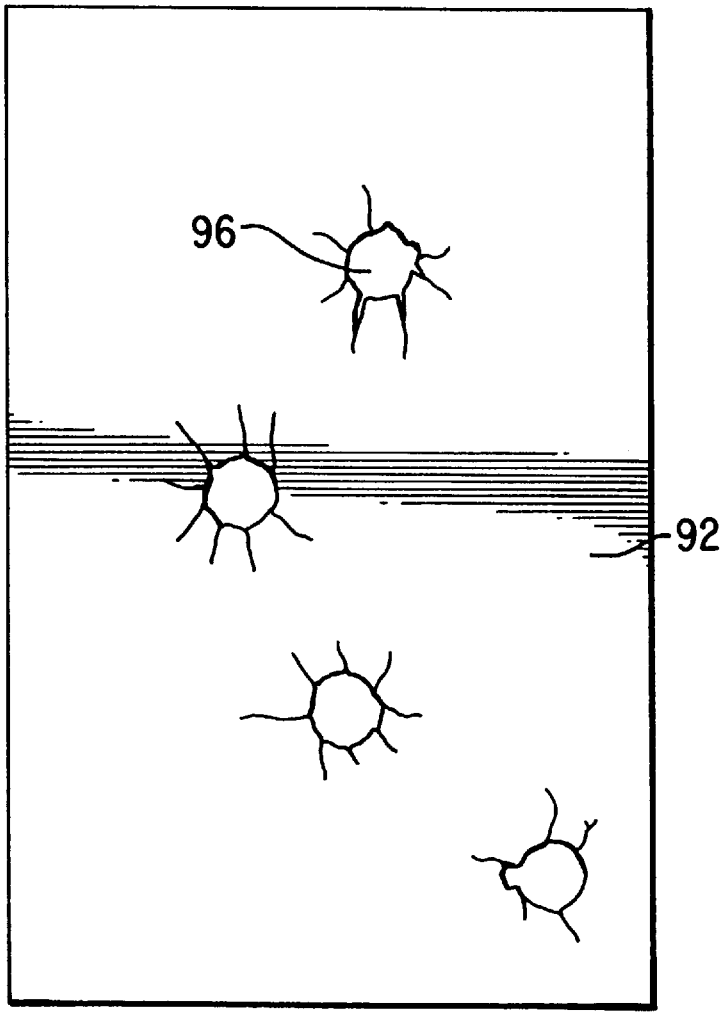
FIG. 16 shows an impact pattern of the projectile of the invention at 60 feet with a rifled extension.

FIG. 16 shows the circular holes 96 formed at 60 feet by the zinc based projectiles of FIG. 6 when fired at paper target 92 from an industrial ballistic tool having a rifled extension. The projectile accuracy was also enhanced as evidenced by the clustering of the circular holes 96.

It is apparent that there has been provided in accordance with the present invention a zinc based projectile having ballistic stability that fully satisfies the objects, means and advantages set forth hereinabove. While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A combination of an 8-gauge or larger shotgun shell and an industrial ballistic tool having a rifled portion, comprising:

a metallic base cup having a primer disposed therein;

a cylindrical plastic tube having one end bonded to said metallic cup and an opposing end, the combination of said metallic cup and said plastic tube defining a cavity;

a ballistic charge disposed within said cavity in communication with said primer;

a zinc or zinc alloy projectile, a cylindrical, smooth surface, rear portion of which is encased in said cylindrical plastic tube and in direct contact with said cylindrical plastic tube, having a weight of from about 3 ounces to in excess of 3 ounces that is sufficiently soft to engage rifling extending from said rifled portion and thereby impart said metallic slug with spin stabilization, said zinc or zinc alloy projectile having symmetry about a longitudinal axis and having said cylindrical rear portion with a first substantially constant radial circular cross-sectional area of a diameter effective to engage said rifling, a cylindrical, smooth surface, mid-portion with a second substantially constant radial circular cross-sectional area that is less than said first substantially constant radial circular cross-sectional area and a tapered forward portion with a forwardly decreasing radial circular cross sectional area, a cross-sectional area discontinuity being disposed between said cylindrical rear portion and said cylindrical mid-portion and aligned with an open end of said plastic tube, wherein a center of gravity of said zinc or zinc alloy projectile is rearward of said cross-sectional area discontinuity;

a cushioning material disposed between said rear portion and said ballistic charge; and a crimp extending from said open end of said plastic tube about said cross-sectional area discontinuity thereby sealing said zinc or zinc alloy projectile in said shotgun shell.

2. The combination of claim 1 wherein said zinc or zinc alloy projectile contains from about 4% to about 6%, by weight, of aluminum and the balance is substantially zinc.

3. The combination of claim 1 wherein said forward portion has a forward end diameter that is from 30% to 50% of a diameter of the rear portion of said zinc or or zinc alloy projectile.

4. The combination of claim 1 wherein said rear portion has a diameter that is from about 0.001 inch to about 0.005 inch greater than the distance between rifling extending from opposing des of said rifled portion.

5. The combination of claim 4 wherein said rifling has a gain twist of between 30 inches and 40 inches.

6. The combination of claim 5 wherein said rifling is on a discrete extension coupled to a muzzle end of said ballistic tool.

* * * * *